US006183858B1

(12) United States Patent
Kanazaki

(10) Patent No.: US 6,183,858 B1
(45) Date of Patent: Feb. 6, 2001

(54) THERMAL TRANSFER RECORDING SHEET

(75) Inventor: Takeshi Kanazaki, Tokyo (JP)

(73) Assignee: Nisshinbo Industries, Inc., Tokyo (JO)

( * ) Notice: Under 35 U.S.C. 154(b), the term of this patent shall be extended for 0 days.

(21) Appl. No.: 09/154,162

(22) Filed: Sep. 16, 1998

(30) Foreign Application Priority Data

Oct. 3, 1997 (JP) ..... 9-286287

(51) Int. Cl.[7] ..... B41M 5/26

(52) U.S. Cl. ..... 428/331; 428/195; 428/207; 428/913; 428/914

(58) Field of Search ..... 428/195, 913, 428/914, 330, 207, 331

(56) References Cited

U.S. PATENT DOCUMENTS 4,216,106 * 8/1980 Miller .

5,075,153 * 12/1991 Malhotra .

* cited by examiner

*Primary Examiner*—Pamela R. Schwartz
(74) *Attorney, Agent, or Firm*—Wenderoth, Lind & Ponack, L.L.P.

(57) ABSTRACT

A thermal transfer recording sheet exhibiting excellent dot transfer at low energy and excellent ink luster of printed graphics comprises a base material and an ink-receiving layer on at least one side of the base material, the ink-receiving layer having a thickness of not less than 1$\mu$ and less than 20 $\mu$m and containing a pigment component composed of not less than 30 wt % of calcined kaolin whose oil absorption value is not less than 45% as measured by the Gardner-Coleman method. The ink-receiving layer contains a hydrophobic binder resin that preferably has a glass transition temperature in the range of −30° C. to +30° C. The calcined kaolin preferably has a mean particle diameter of 1–3 $\mu$m.

1 Claim, No Drawings

THERMAL TRANSFER RECORDING SHEET

BACKGROUND OF THE INVENTION

1. Field of the Invention

This invention relates to a fusion thermal transfer recording sheet, particularly to a thermal transfer recording sheet excellent in low-density dot reproduction performance and ink luster of printed graphics.

2. Description of the Background Art

As a thermal transfer recording sheet exhibiting good oil absorptivity, Japanese Patent Application Publication No. 5-78439 teaches a sheet having an ink-receiving layer composed mainly of a water-soluble high polymer and a porous pigment such as calcined kaolin.

On the other hand, Japanese Patent Application Laid-open No. 62-278088 teaches a thermal transfer recording sheet having an ink-receiving layer composed mainly on an inorganic pigment such as calcined kaolin and a high polymer adhesive formed on a biaxial oriented film.

The sheet using water soluble high polymer has inferior ink compatibility and is poor in printability owing to its low affinity for the ink.

The sheet using biaxial oriented film is required to have its ink-receiving layer made 20–50 $\mu$m thick in order to block heat that would otherwise cause thermal curling at the time of pressure contact with the thermal head.

Unlike these earlier technologies, the present invention provides a thermal transfer recording sheet that uses a hydrophobic binder resin, can have its ink-receiving layer reduced to a thickness between 1 $\mu$m and less than 20 $\mu$m, is excellent in low-density dot reproduction performance, is excellent ink luster of printed graphics, and exhibits high optical density at maximum energy.

SUMMARY OF THE INVENTION

The object of this invention is to overcome the aforesaid problems of the prior art by providing:

(1) a thermal transfer recording sheet comprising a base material and an ink-receiving layer on at least one side of the base material, the ink-receiving layer having a thickness of not less than 1 $\mu$ and less than 20 $\mu$m, containing a pigment component composed of not less than 30 wt % of calcined kaolin whose oil absorption value is not less than 45% as measured by the Gardner-Coleman method, and containing a hydrophobic resin as binder resin, (2) the thermal transfer recording sheet set out in (1) above, wherein the hydrophobic binder resin contained in the ink-receiving layer has a glass transition temperature in the range of −30° C. to +30° C., and (3) the thermal transfer recording sheet set out in (1) or (2) above, wherein the calcined kaolin contained in the ink-receiving layer has a mean particle diameter of 1–3 $\mu$m.

DETAILED DESCRIPTION OF THE PREFERRED EMBODIMENTS

The invention will now be explained in detail with reference to preferred embodiments.

Paper or plastic film is used as the base material. While the paper can be ordinary paper, use of a high-grade paper, coated paper or the like having a Beck smoothness of not less than 100 seconds is preferable. Although the plastic film is not particularly limited, preferable for use are those made of polyethylene terephthalate, polypropylene, polyvinyl chloride and polystyrene, and foamed films and calcium carbonate or other inorganic pigment-containing films made from any of these.

An ink-receiving layer is provided on at least one side of the base material. The ink-receiving layer is composed mainly of pigment and binder resin.

The pigment component includes not less than 30 wt % of calcined kaolin whose oil absorption is not less than 45%, preferably not less than 50%, as measured by the Gardner-Coleman method. When the pigment component includes 30 wt % or more of calcined kaolin, printed graphics exhibit excellent ink luster and brilliant color graphics can be obtained.

Calcining kaolin at 600–800° C. breaks down its original crystal structure by releasing water of crystallization and also decomposes organic and other impurities mixed with the kaolin. The calcined kaolin is therefore uniform in particle size and exhibits excellent dispersability. When it is used as a pigment for forming the ink-receiving layer, the gaps formed among the calcined kaolin particles are uniform and admit an appropriate amount of ink, not an excessive amount, so that the ink firmly fixes in the vicinity of the ink-receiving layer surface. This is thought to be why use of the calcined kaolin results in excellent ink luster of printed graphics.

When the calcined kaolin accounts for less than 30 wt % of the pigment component, however, the content of the other pigments such as silica increases to cause excessive impregnation of ink into the ink-receiving layer. Printed graphics therefore appear matted and the ink at these portions loses its luster, making it impossible to obtain brilliant color graphics.

In order to secure good low-density dot reproduction performance and a high optical density value at maximum energy (OD value), the calcined kaolin should preferably have an oil absorption value of not less than 45% as measured by the Gardner-Coleman method. When the oil absorption is less than 45%, the resin and/or wax component of the ink fused by thermal energy from the thermal head is liable not to fix sufficiently on the ink-receiving layer. This impairs dot reproduction performance in low-density region and lowers the optical density value at maximum energy (OD value).

Low-density dot reproduction performance refers to the dot reproduction performance when the surface temperature (energy) of the thermal head is low during thermal transfer. The density of the ink at the thermal head is low at such times. Maximum energy in terms of OD value refers to the case when the surface temperature of the thermal head is maximum. The density of the ink is maximum at such times.

The pigment or pigments other than calcined kaolin should also preferably have oil absorption value(s) of 45% or higher as measured by the Gardner-Coleman method. Although the other pigment or pigments are not particularly limited other than by the requirement to satisfy this condition, preferably usable ones include such inorganic pigments as synthetic silica, clay, talc, diatomaceous earth, calcium carbonate, titanium oxide, zinc oxide and satin white and such organic pigments as polystyrene, poly (methyl methacrylate) and styrene-acryl copolymer.

Use of pigments that have a mean particle diameter of 1–3 $\mu$m and are uniform in particle size is preferable. When the average particle diameter of the pigments is in this range, the pigments are fine enough to pack densely in the ink-receiving layer. Sufficient heat insulating property to prevent thermal curling by heat from the thermal head during graphic printing can therefore be obtained even with an ink-receiving layer that is less than 20 $\mu$m thick. When the mean particle diameter of the pigments is less than 1 $\mu$m, the gaps of the ink-receiving layer to be charged with ink are so small that the ink-receiving layer can retain hardly any ink. This particularly degrades low-density dot reproduction performance. The upper limit of the oil absorption, while not particularly specified, is generally lower than around 120%. The pigment component can consist of 100% calcined kaolin. The Gardner-Coleman method (ASTMD1483) calculates oil absorption by the following equation.

$$A = \{(M \times 0.93)/P\} \times 100,$$

where

A: oil absorption (%)

M: amount of oil (ml)

P: amount of pigment (g)

0.93: oil density (g/ml)

The ink ribbon is ordinarily constituted by forming an ink layer composed mainly of resin and/or wax on a base material of PET film.

The binder resin of the ink-receiving layer, which needs to be compatible with the resin and/or wax constituting the ink, is preferably a hydrophobic resin with a glass transition temperature in the range of −30° C. to +30° C.

If the glass transition temperature of the binder resin is higher than 30° C., the transfer performance to the binder resin of the resin and/or wax constituting the ink becomes sluggish for a given level of thermal energy of the thermal head. This particularly degrades the low-density dot reproduction performance. If the glass transition temperature is below −30° C., the adherence between the ink-receiving layer of the recording sheet and the ink (composed mainly of resin and/or wax) on the ink ribbon in contact with the surface of the ink-receiving layer becomes abnormally strong. This leads to backward transfer of a portion of the ink-receiving layer to the ink ribbon side during separation of the ink ribbon from the ink-receiving layer.

Usable binder resins include, for example, polyvinyl chloride, polyvinylidene chloride, saturated copolymerized polyester, vinyl chloride-vinyl acetate copolymer, alkyd resin, acrylic resin, SBR (styrene-butadiene rubber), ABS (acrylonitrile-butadiene-styrene copolymer) and the like.

The ratio F/R of pigment solids content (F) to total binder solids content (R) is preferably 0.5 to 3.0. The ink-receiving layer constituted in the foregoing manner has superb smoothness. Specifically, it achieves a Beck smoothness (JIS-P8119) of 4,000 seconds or higher even when not enhanced in smoothness by calendaring or similar treatment. As such, it is excellent for use as the surface layer of thermal transfer graphic recording paper. It also excels in printer feeding performance and the like.

The thickness of the ink-receiving layer is preferably in the range of not less than 1 μm to less than 20 μm, more preferably 3–15 μm. An ink-receiving layer of a thickness falling below this range is not preferable because it is so inferior in ink absorptive power that it takes up hardly any ink and makes fixing of the ink difficult. Generally speaking a sheet coated on only one side tends to curl owing to contraction of the binder resin during the drying effected to remove solvent after application of the coating liquid. When the thickness of the ink-receiving layer is within the range specified by the invention, however, the effect of binder resin contraction does not extend throughout the thermal transfer recording sheet and no curl arises even if only one side of the sheet is coated. It therefore becomes possible to provided excellent graphic recording paper exhibiting the aforesaid properties.

Curl occurring at the time of graphic printing is of such a low level as to cause no problem from the viewpoint of a commercial product. Other advantages obtained owing to the thinness of the ink-receiving layer include:

1. The ink-receiving layer is excellent in scratch resistance and bonding with the base material;
2. Since the opacity of the ink-receiving layer is not excessive, a thermal transfer recording sheet with good luster can be obtained; and
3. Since the ink-receiving layer does not take up excessive ink, the luster of the ink (graphics) after printing is superb.

EXAMPLE 1

Polypropylene film incorporating calcium carbonate (Yupo FPG-80, product of Oji-Yuka Synthetic Paper Co., Ltd.) was used as the base material.

A coating liquid was prepared by using a sand grinder (SLG-4G Screenless Sand Grinder, product of Aimex Co., Ltd.) to disperse 100 parts by weight of calcined kaolin pigment (Altowhite TE, product of Georgia Kaolin, Inc.; oil absorption: 70%, mean particle diameter: 2.2 μm) and 270 parts by weight of polyester binder (Vylonal MD-1400, product of Toyobo Co., Ltd.; solids content: 15%, glass transition temperature: 23° C.) in 100 parts by weight of water. A thermal transfer recording sheet according to the invention was obtained by using a reverse roll coater to coat one side of the base material with the coating liquid to a thickness after drying of 10 μm.

EXAMPLE 2

A coating liquid was prepared by using the same sand grinder to disperse 100 parts by weight of calcined kaolin pigment (Glowmax LL, product of Georgia Kaolin, Inc.; oil absorption: 50%, mean particle diameter: 1.5 μm) and 140 parts by weight of polyester binder (Pesresin A-193, product of Takamatsu Oil and Fat Co., Ltd.; solids content: 30%, glass transition temperature: −30° C.) in 160 parts by weight of water. A thermal transfer recording sheet according to the invention was obtained by using a reverse roll coater to coat one side of the same kind of base material as in Example 1 with the coating liquid to a thickness after drying of 10 μm.

EXAMPLE 3

A coating liquid was prepared by using the same sand grinder to disperse 70 parts by weight of calcium carbonate pigment (light calcium carbonate, product of Maruo Calcium Co., Ltd.; oil absorption: 46%; mean particle diameter: 2.0 μm) and 30 parts by weight of calcined kaolin pigment (Alwhite UF, product of Georgia Kaolin, Inc.; oil absorption: 70%, mean particle diameter: 1.1 μm) in 100 parts by weight of acrylic binder (Ultrazole FCX-4, product of Ganz Chemical Co., Ltd.; solids content: 41%, glass transition temperature: −20° C.). A thermal transfer recording sheet according to the invention was obtained by using a reverse roll coater to coat one side of the same kind of base material as in Example 1 with the coating liquid to a thickness after drying of 10 μm.

COMPARATIVE EXAMPLE 1

A thermal transfer recording sheet was prepared under the same conditions as in Example 1 except for using only the calcium carbonate of Example 3 as pigment.

COMPARATIVE EXAMPLE 2

A thermal transfer recording sheet was prepared under the same conditions as in Example 1 except that the calcined kaolin was changed (to Glowmax JDF, product of Georgia Kaolin, Inc.; oil absorption: 40%, mean particle diameter: 0.6 μm).

Using a commercially available printer, the thermal transfer recording sheets obtained in the foregoing Examples and Comparative Examples were printed with a test pattern separated into 16 gradations in order of increasing thermal energy from level 1 to level 16. The print density of the magenta ink was measured with a Macbeth densitometer (RD918, product of Macbeth Co., Ltd.). The printed pattern was also observed visually. Based on the results, the graphic print quality of each sheet was rated as excellent (◎), good (O) or poor (X), with good (O) or better being considered satisfactory. The results are shown in Table 1.

TABLE 1

| | Low-density dot reproduction performance[1] | Ink luster of graphics | Optical density at max energy[2] |
|---|---|---|---|
| Example 1 | ◎ (Level 2) | ◎ | ◎ (1.78) |
| Example 2 | ◎ (Level 2) | ◎ | ◎ (1.68) |
| Example 3 | ○ (Level 3) | ○ | ◎ (1.72) |
| Comparative Example 1 | X (Level 4) | X | X (1.48) |
| Comparative Example 2 | X (Level 4) | ○ | X (1.52) |

[1]Low-density dot reproduction performance was evaluated as the lowest energy level (shown in parentheses) at which dot transfer could be visually observed. High-definition graphics are hard to obtain at a low-density dot reproduction performance of level 4 or higher.

[2]The figures in parentheses indicate the value of optical density at maximum energy. A value of 1.65 or higher was rated excellent and one of 1.54 or lower poor.

The meritorious effects of the invention can be listed as follows:

1. Excellent low-density dot reproduction performance.
2. Excellent ink luster of printed graphics.
3. Brilliant color graphics.
4. High optical density at maximum energy (OD value).
5. Beck smoothness (JIS-P8119) of 4,000 seconds or higher; excellent printer feeding performance.
6. No curling even with single-side coating.

What is claimed is:

1. A thermal transfer recording sheet consisting essentially of a base material and an ink-receiving layer on at least one side of the base material, the ink-receiving layer having a thickness of not less than 1 $\mu$ and less than 20 $\mu$m, containing a pigment component composed of not less than 30 wt. % of calcined kaolin whose oil-absorption value is not less than 45% as measured by the Gardner-Coleman method and a binder resin consisting essentially of a hydrophobic resin having a glass transition temperature in the range of −30°to +30° C.

* * * * *